US005823845A

United States Patent [19]

O'Berrigan

[11] Patent Number: 5,823,845

[45] Date of Patent: Oct. 20, 1998

[54] MOBILE, GYROSCOPICALLY STABILIZED TOY WITH CONTROLLED MULTI-ACTION MOVEMENTS

[75] Inventor: Kieran J. O'Berrigan, Kearney, N.J.

[73] Assignee: Kieran Bergin, Inc., Kearney, N.J.

[21] Appl. No.: 615,034

[22] Filed: Mar. 12, 1996

[51] Int. Cl.[6] ..... A63H 1/20; A63H 30/04; A63H 7/00

[52] U.S. Cl. ..... 446/234; 446/456; 446/355

[58] Field of Search ..... 446/233, 234, 446/235, 456, 330, 335, 336, 352, 353, 354, 355, 358

[56] References Cited

U.S. PATENT DOCUMENTS

| | | | |
|---|---|---|---|
| 750,134 | 1/1904 | Vaile | 446/336 X |
| 1,136,465 | 4/1915 | Clark, Jr. | 446/336 X |
| 1,434,329 | 10/1922 | Dorozynski | 446/330 X |
| 2,346,117 | 12/1944 | Wigal | 446/234 |
| 2,371,368 | 3/1945 | Wallace | 446/233 X |
| 2,513,066 | 6/1950 | Stahl . | |
| 2,588,040 | 3/1952 | Perez | 446/234 X |
| 2,881,559 | 4/1959 | Glass . | |
| 3,036,404 | 5/1962 | Berger | 446/353 X |
| 3,722,136 | 3/1973 | Thorn et al. . | |
| 3,775,900 | 12/1973 | Thorn et al. . | |
| 4,346,893 | 8/1982 | Landsinger . | |
| 4,365,437 | 12/1982 | Jameson | 446/355 |
| 4,713,039 | 12/1987 | Wong . | |
| 4,772,241 | 9/1988 | Bro et al. | 446/234 X |
| 4,828,530 | 5/1989 | Lee | 446/330 X |
| 4,867,730 | 9/1989 | Lee | 446/330 X |
| 5,045,015 | 9/1991 | Arad et al. . | |

FOREIGN PATENT DOCUMENTS

| | | | |
|---|---|---|---|
| 0201626 | 11/1986 | European Pat. Off. | 446/355 |
| 439865 | 6/1912 | France | 446/354 |

*Primary Examiner*—Robert A. Hafer
*Assistant Examiner*—D. Neal Muir
*Attorney, Agent, or Firm*—Klauber & Jackson

[57] ABSTRACT

In one embodiment, a toy having a body for housing and supporting its various constituent elements, the elements including: a gyroscopic mechanism, mounted therein so as to gyrostabilize the toy, which includes a rotor mounted on an axle and a mechanism for attaching the axle so that it is free to rotate about one or both of two axes which are perpendicular to each other and to the axis of spin; a selectively, intermittently operable drive mechanism for causing the axle and the rotor to spin with sufficient speed to gyrostabilize the toy; one or more appendages attached to and supported by the body portion of the toy, optionally operatively connected by a transmission to the selectively, intermittently operable drive mechanism, or to an independent drive mechanism, for moving the one or more appendages in a predetermined manner; and a mechanism for permitting independent directional movement of the toy, on which the body portion is supported and which resists the natural precessional forces of the gyroscopic means.

24 Claims, 5 Drawing Sheets

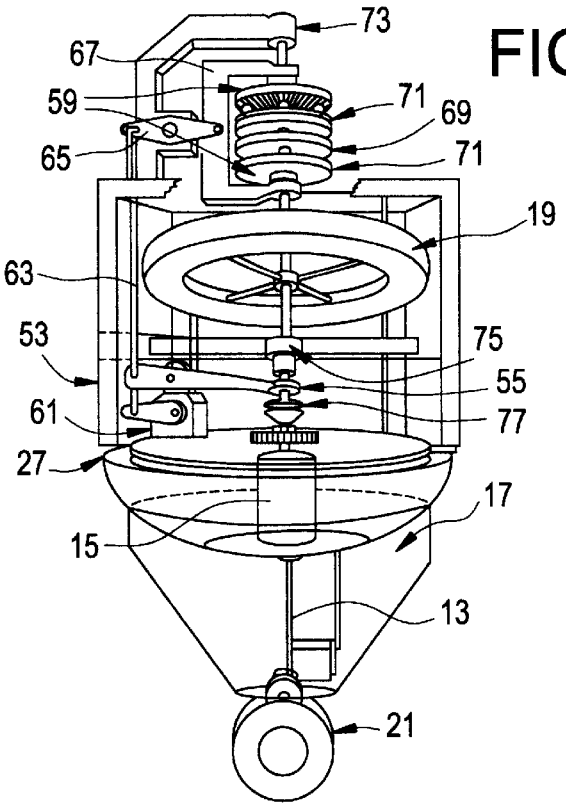
FIG.3
FIG.4
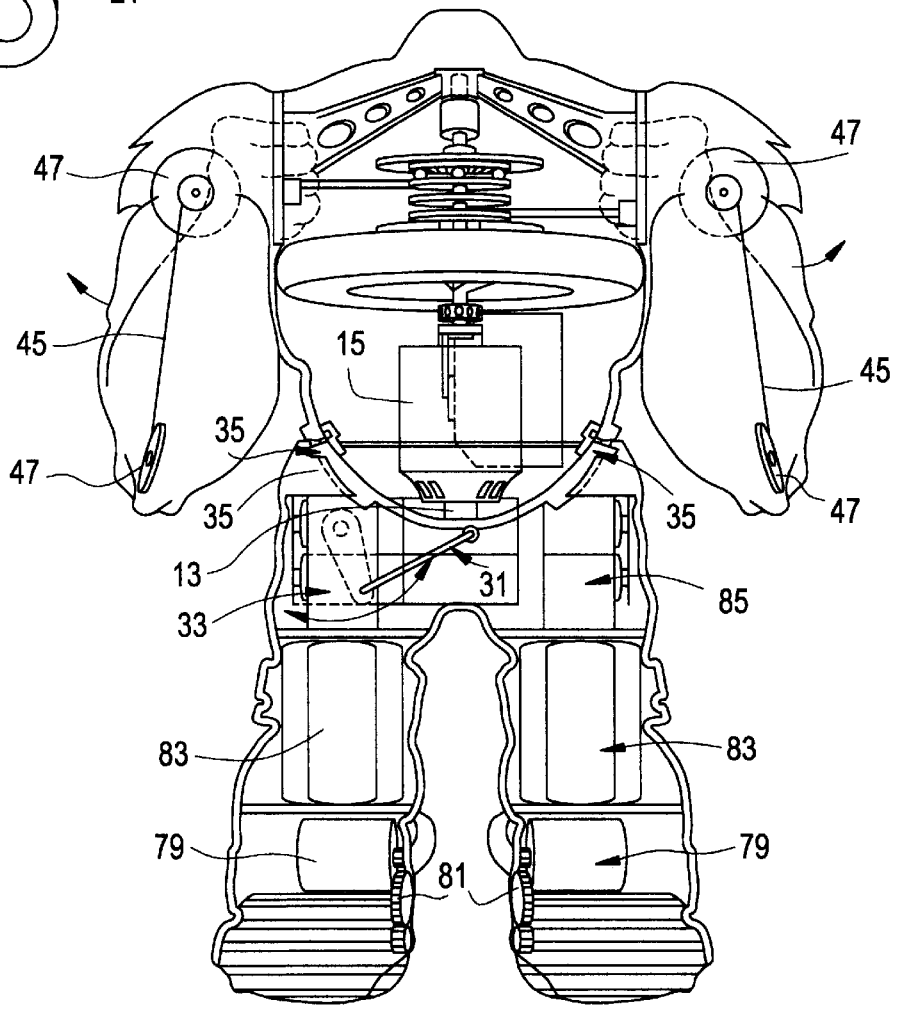

MOBILE, GYROSCOPICALLY STABILIZED TOY WITH CONTROLLED MULTI-ACTION MOVEMENTS

FIELD OF THE INVENTION

The present invention is in the field of mobile toys, especially human and animal figures of various kinds, having a multiplicity of mechanical movements, often electrically driven and with remote control features. The present invention is also in the field of mobile toys which have incorporated therein a gyroscope which is driven by a power source and imparts stability to the movements of the toy. However, the present invention is believed to be the first to bring together all of the above elements to create a toy which uniquely provides not only directional motion, and particularized and reproducible movements of the constituent parts thereof, which can also be remotely controlled, but which also provides a substantially total stability in relation to gravity which imparts a novel range of actions to the toy.

BACKGROUND OF THE INVENTION

Toys, especially those which emulate human and animal figures, and which have a range of movement and action in their constituent parts which mimic the natural gestures of the original creatures, have long been a staple of the toy manufacture's art. The power source used to produce these motions of the toy parts has varied from the kinetic energy established in a flywheel by pulling a line to rotate an axle on which the flywheel is mounted, to the potential energy imparted to a mainspring by winding it, to an electric motor powered by a battery as the source of electrical current. In common, however, these power sources are contained within the structural confines of the toy figure itself and are concealed, in order to enhance the life-like appearance of the toy. It is quite frequently the case, however, that the sole objective with such toy figures is a natural appearing mechanical movement of the arms, legs, head and torso, and similar features, to the exclusion of independent motion of the toy figure itself. Such independent directional movement presents a significant array of new problems to be solved, not the least of which is gravitational stability, i.e., the ability to maintain an upright stance while in motion and achieve sufficient balance to resist those outside forces which tend to overturn the toy.

Toys configured to provide powered, independent, preselected directional movement of the toy itself, usually achieve gravitational stability by combining one or more stratagems, e.g., three or more wheels, a low-slung body which prevents overturning, out-rigger assistance, a low center of gravity, differential weighting, etc. However, the most effective means of providing gravitational stability, i.e., incorporating an active gyroscope into the structural makeup of the toy, has never been successfully pursued in the toy-making art because of the tendency of an operating gyroscope to resist movement in a straight line. Consequently, toys incorporating active gyroscopes in their designs have either been in the class characterized by random motion, i.e., uncontrolled movement, e.g., tops spinning about a single point; or else they have been in the class characterized by movement along a fixed track, e.g., a cable or line on which a grooved wheel moves. Thus, the toy-making art has up until now considered as not feasible the concept of a gyroscopically stabilized toy capable of controlled, independent motion. Accordingly, it is an object of the present invention to provide such a novel class of toys, characterized by remotely controlled motion and action, a stance and independent directional movement focused on a significantly small locus yet possessing a gravity-defying ability to maintain balance and upright stance when acted on by outside, opposing forces.

As is well known, a gyroscope consists of a rapidly rotating flywheel or rotor set in a framework of gimbal rings that permits it to tilt freely in any direction, i.e., to rotate about any axis, and gyroscopes are typically constructed in three-frame and two-frame configurations. The momentum of the spinning flywheel or rotor causes it to retain its original attitude when the framework is tilted; and this elemental characteristic of gyroscopes has been the basis for a number of useful applications heretofore, e.g., the gyrocompass. Gyroscopic inertia or rigidity in space is dependent upon the rotor speed, and rotors with a high speed and a concentration of mass toward the rim of the flywheel display the strongest gyroscopic inertia. Another elemental characteristic of gyroscopes is precession, i.e., the tendency of the rotor's axis to move at right angles to any perpendicular force applied to it. Thus, if a two-frame gyroscope with its rotor spinning and with its spin axis in the horizontal plane, has its base rotated uniformly in the horizontal plane, a definite resistance will be felt as a result of gyroscopic inertia, and at the same time the spin axis will begin to precess in the vertical plane and continue until the axis is vertical and all gyroscopic inertia disappears. If this procedure is repeated, except that while the base is being turned in the horizontal plane, the precessional movement of the spin axis is stopped by the application of force to the end of the rotor axle where it terminates in its gimbal ring, the resistance to the turning motion due to gyroscopic inertia will cease to exist. Thus, the precession process will, in effect, have been reversed. Consequently, a vertical downward force applied to the end of the rotor axle introduces a torque, i.e., twisting force that makes the base precess at the same rate and in the same direction as the turning movement of the gyroscope base. The quicker the base is turned, the greater the force that must be exerted on the axle to stop the precession. Accordingly, it is known that there is resistance to the turning motion of the base of a gyroscope if, and only if, the spin axis precesses; and that the force needed to stop the precession is directly proportional to the rate of turning of the base. These well-known principles are necessary not only for appreciating the reasons why the toy-making art has failed to discover mobile, gyroscopically-stabilized toys of the type provided by the present invention, but for understanding as well, the manner in which the toys of the present invention achieve their novel and characteristic, particularized and reproducible movements and gestures.

BRIEF DESCRIPTION OF THE PRIOR ART

The teachings in the prior art of toy-making show a limited appreciation of the beneficial role which a gyroscopic component in such toys might play. There is no disclosure that a gyroscopic system may be incorporated into a toy and used to stabilize its movements and to achieve other improvements in its performance. For example, U.S. Pat. No. 2,513,066 to Stahl discloses a gyroscopically balanced rope walking toy, but the toy is not self-propelled, but rather is moved and guided by raising and lowering the cord on which it moves. The gyroscope is not moved by a continuous motor force, but rather is propelled by the application of a blast of air from the operator; and the toy figure has no movable body parts, but rather is simply a housing for the gyroscope, air blast passage, and rotatably mounted grooved wheel on the toy moves. U.S. Pat. No. 2,588,040 to Perez discloses a gyroscopically stabilized toy, including the concept of using the driving power for the gyroscope on a central, vertical shaft to provide movement to the limbs of the toy figure. The gyroscope is powered by the pulling of a cord wound around the shaft, and the toy is not limited to moving on a grooved wheel. The concept of variability in the casing, leg members and base assembly to provide different kinds of toys is also taught. However, as with Stahl, there is no suggestion of motor-driven movement of the arms or other parts of the toy figure, and the teachings in Perez are tied to a rope walking type of toy figure, with the addition of only somewhat limited leg movement There is also no appreciation whatever in Perez that gyroscopic precession can be avoided by means other than a grooved wheel on a suspended line of some sort. U.S. Pat. No. 4,713,039 to Wong discloses a toy which utilizes a continuously moving, motor-driven gyroscope. However, the toy is a top with a variable sound making feature and flashing lights; there is no suggestion of a toy figure.

The toy-making art is replete with teachings regarding the construction of mechanized, motor-driven toy figures, but only limited mobility of the toy figures themselves is contemplated, and there is no suggestion of the use of a gyroscopic system to stabilize such movement. For example, U.S. Pat. No. 2,881,559 to Glass discloses a toy figure with continuous motor driven and controllable movement of various body parts, and with two wheels for balance, a traction wheel and a steering wheel. However, there is no suggestion of using a gyroscope, and the arm movements are limited to a rather crude oscillating, action, while control of the direction of movement of the toy figure is also very crude. U.S. Pat. No. 3,722,136 to Thorn and Berkin discloses a toy doll whose arms are separately and independently driven by a reversible electric motor, by means of unidirectional clutches, while the doll's head and torso are also oscillated to simulate human movement. Control of these movements is described, although independent remote control does not appear to be contemplated. The legs pivot about the torso, permitting the doll to be seated, but independent directional movement of the toy doll itself is not described and there is no disclosure of the use of a gyroscope. U.S. Pat. No. 3,775,900 to Thorn and Ieda discloses a toy doll similar to that in Thorn and Berkin, but additionally having articulated joints in the arms. However, the doll can be placed in a seated position, is not capable of independent directional movement by itself, does not use a gyroscope, and is not operated by independent remote control. U.S. Pat. No. 5,045,015 to Arad et al discloses a toy doll similar to the one of Thorn and Ieda, but in which the legs are also mechanically driven so that the doll can move over a surface in an upright position, and together with the movement of the arms, simulate the gestures of a ballerina. However, it is contemplated that the operator will hold the doll in an upright position, and there is no suggestion of the use of a gyroscope. Independent remote control is not taught, but rather control is achieved by mechanical means which are located within the doll itself. U.S. Pat. No. 4,346,893 to Landsinger and Bosley discloses independently remotely controllable wheel driven sports figures configured for engaging a game object such as a ball or a puck. However, these figures are driven by two wheels, and upon reversal of drive direction, a spring clutch pivots a cam slide to permit movement of the figure in a tight turning radius. There is no suggestion of either a continuously motor-driven gyroscope or of motor-driven limbs.

BRIEF DESCRIPTION OF THE DRAWINGS

FIG. 3 is a perspective view from the side of the inside components of a toy figure such as the type depicted in FIG. 1.

FIG. 4 is a front view, partly in section, of a toy figure of the present invention whose independent directional movement is by means of two legs.

SUMMARY OF THE INVENTION

Figure 1:
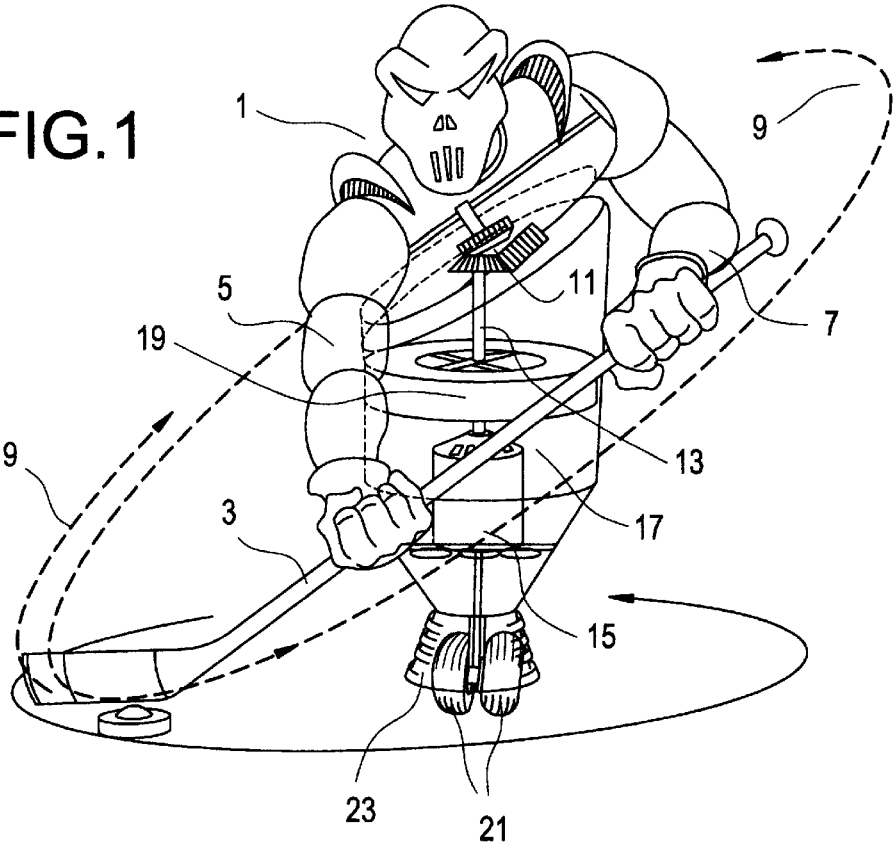
FIG. 1 is a perspective sectional view of a toy figure constructed in accordance with the present invention, whose independent directional movement is through what amounts to a single point.

In accordance with the present invention there is provided a toy comprising a body portion for housing and supporting various hereafter-recited constituent elements of said toy; gyroscopic means mounted in said body so as to gyrostabilize said toy, comprising a rotor mounted on an axle and spinning about an axis, and means for attaching said axle to said body so that it is free to rotate about one or both of two axes perpendicular to each other and to said axis of spin; selectively, intermittently operable drive means for causing said rotor mounted on said axle to spin with sufficient speed to gyrostabilize said toy; one or more appendages attached to and supported by said body portion operatively connected by transmission means to said selectively, intermittently operable drive means, or to an independent drive means, for moving said one or more appendages in a predetermined manner; and means for permitting independent directional movement of said toy, on which said body portion is supported and which resists the natural precessional forces of said gyroscopic means.

The present invention further concerns a toy of the type described above, in which the body portion thereof is, in particular, a human or animal figure, subportions of which, e.g., the torso, are movable in relation to other portions thereof, and the one or more appendages attached thereto are the head, arms, legs, trunk, tail, etc. of such a figure, and they are pivotally mounted thereon. It is also contemplated that such an appendage, especially an arm of a human figure, may have associated therewith an object such as a piece of sports equipment or a weapon. The gyroscopic means for gyrostabilizing the toy is preferably of the two-frame type and the rotor, or flywheel, has appreciable mass concentrated toward its rim. The selectively, intermittently operable drive means is preferably an electric motor powered by an electric battery. The selectively, intermittently operable drive means must keep the rotor of the gyroscopic means spinning rapidly, but to accomplish this it is only necessary to power it on an intermittent basis. In this way, the drive means can also power, e.g., the appendages of the toy and its directionalmotion.

The considerable mass of the spinning gyroscopic flywheel will continue to confer gyroscopic stability to the toy during those periods when the drive means is not actively powering the flywheel. In fact, during a typical operation of the toy, the gyroscopic flywheel will be powered up initially and made to spin rapidly, after which the drive means will be devoted exclusively to creating the various actions of the toy, while the inertia of the spinning flywheel maintains the stability of the toy. Optionally, a sensor means can be installed inside the toy that will be able to detect and recognize the speed of the flywheel, or optionally the degree of stabilization being provided to the toy by the gyroscopic means. When the flywheel reaches a predetermined speed that corresponds to an undesirable decline in the stability provided by the gyroscopic flywheel, other means can be provided that send a visual signal, e.g., a flashing red light, that advises the operator of the toy that the transmission links in the toy should be changed so as to reconnect the selectively, intermittently operable drive means to the axle of the gyroscopic stabilizing means. In this way, the optimum speed of the gyroscopic flywheel can always be maintained in the toy.

Accordingly, the drive means may be operatively connected to the rotor of the gyroscopic means by transmission means, preferably a drive shaft. Such transmission means are also used to operatively connect the one or more appendages of the toy to the selectively, intermittently operable drive means. The one or more appendages will also preferably have associated therewith mechanical linkages for imparting a variety of movements and gestures thereto. The selective and intermittent operability of the drive means may be used to power the gyroscopic means only, the movement of the appendages only, the directional movement of the toy only, or any combination of these. It is not necessary that the means for permitting independent directional movement of the toy be operably connected to the selectively, intermittently operable drive means, but this is a preferred embodiment of the present invention. The same type of transmission means may be used to achieve this operable connection to the drive means. The means for permitting independent directional movement of the toy, on which the body portion is supported and which resists the natural precessional forces of the gyroscopic means, preferably comprises one or more wheels, rollers, spheres or trades having a composition, cross section, or configuration, or any combination of these, which resists the natural precessional forces of the gyroscope, e.g., they may be made from an anti-skid material. Additionally, the toy of the present invention is preferably also equipped with switching means in electrical communication with the electric motor through connection means, in order to make it selectively operable. More preferably still, the toy is equipped with remote control means consisting of transmitting means and receiving means, so that the selective operability of the drive means is controlled remotely by means of radio signals.

DETAILED DESCRIPTION OF THE INVENTION

The first portion of the toy according to the present invention comprises a body for housing and supporting various constituent elements of that toy. The body portion can be constructed in a wide variety of forms and from a wide variety of materials. The body portion houses and supports the other elements of the toy, and will vary considerably depending upon the nature of toy being fabricated. Where the toy is a vehicle, building or some other inanimate object, the body portion may only be a simple framework. It is not required in all cases that the body portion be hollow, i.e., form a casing means which surrounds those other elements.

Where the body portion is a human or animal figure, the body portion of the toy figure will usually comprise an exterior shell which provides housing and a desired appearance for toy figure, and an interior framework integrated with said exterior shell, which provides structural support and an operational scaffold for all of the other constituent elements of the toy figure. Preferably, the exterior shell and the interior framework are fully integrated by being firmly attached to each other. However, it is also within the scope of the present invention to have an exterior shell which merely hangs on the interior framework It is, nevertheless, integrated therewith because the contours of the exterior shell must conform to the outlines of the interior framework; and more importantly, the various appendages of the toy figure must be connected and attached to the elements of the toy figure which are responsible for producing and powering controlled movement of those appendages. For toy figures, providing sufficient space for all of these elements will usually be most efficiently accomplished by relying on the normal body cavities for this purpose. The interior framework not only provides structural support for the exterior shell and the other constituent elements of the toy figure, but it is an operational scaffold as well. By this is meant that the framework provides a platform for securing such elements as the servos, solenoids, batteries, motors and transmitters/receivers. It also means that the interior framework provides a skeletal structure that permits the application, transmission and reception of mechanical forces in a predictable manner by such elements as the drive means, the gyroscopic stabilizing means and the transmission means involving various mechanical linkages such as clutch and cam assemblies, tie rods, rocker arms, springs, drive shafts, pulleys and cables, gear trains, pivot tracks, shaft engaging arms.

Extensive mechanization of the appendages, and the space requirements for the compartment which must house the gyroscopic means, usually dictate a fabrication technique in which two or more parts of the main body, e.g., the torso, are cast or molded separately and then joined together around the various mechanical means which they are to house to form a shell-like structure. The appendages are then attached to the main body. However, there is no intention to limit the present invention to human and animal figures as the only possible embodiments thereof. The body portion might be the main part of a spacecraft of some particular design, for example, with the appendages being some subsidiary parts thereof.

The types of materials from which the toys of the present invention are fabricated are as variable as the forms which they may take. The most sturdy and inexpensive materials, and the ones least prone to damage, are the polymeric, usually thermoplastic compositions, e.g., polyolefins, polyvinylchlorides, polytetrafluoroethylenes, acrylonitrile-butadiene-styrenes, polymethacrylates, polyamides, polyesters, polystyrenes, and polycarbonates. Thermosetting resins might also be employed, and various combinations of all of these polymeric compositions could, and typically would, be utilized in making the toy. Further strength can be imparted to the polymeric compositions by incorporating therein materials in particulate, fibrous or filamentous form, such as metal, glass, synthetic resin, cellulose and cellulose derivatives, and carbon and carbonaceous compositions, to form composite structures. Metals of various kinds can also be used to fabricate all or part of the toys of the present invention. The relatively high density of such metals as brass, bronze and steel make them especially suitable for making the rotor of the gyroscopic means, and their high strength characteristics make them desirable for making the axle of the gyroscopic means and the various drive means and transmission means. Other metals which are light and yet strong and readily fabricated into desired shapes, e.g., aluminum and titanium, can also be used. Combinations of one or more of the materials described above may be, and usually will be, used in fabricating the toys of the present invention. Where these materials, or more properly, the constituent elements of the toy which they are used to fabricate, come in moving contact with other, resulting in friction and wear, it is desirable to use lubricants, especially in the case of metals. Lubricants of various types, especially the permanent, sealed type, are desirably included in the fabrication of the toys of the present invention in view of the significant number of moving parts that are usually involved.

The gyroscopic means is mounted in the body of the toy so as to gyrostabilize the toy. The spin axis of the gyroscopic means will usually be perpendicular to the plane of the earth, but this is not required, since the gyroscopic inertia, ie., its tendency to retain its original attitude in space when the gyroscope framework is tilted, may be useful in a toy which has other than a natural vertical or upright position. The amount of space in the toy body necessary to accommodate the gyroscopic means is also variable. The gyrostabilization depends on the momentum developed by the gyroscope rotor, which depends in turn on its speed and mass. Routine experimentation can readily determine for a desired degree of gyrostabilization, what rotor weight and speed will be required, with due deference for the fact that the gyroscopic means will be powered only intermittently, usually initially, and therefore what amount of space needs to incorporated into the design. The gyroscopic means itself comprises a rotor mounted on an axle and spinning about an axis, i.e., the spin axis, as well as means for attaching the axle to the body of the toy so that it is free to rotate about one or both of two axes perpendicular to each other and to the axis of spin. This is most easily accomplished by utilizing the twoframe type of gyroscope construction and mounting the rotor axle so that it can spin freely in, e.g., a vertical axis, and then simply allowing the body or the interior framework for the body of the toy to be the mounting for the rotor and axle of the gyroscope. However, the interior framework can also be mounted on gimbals so that it is free to rotate.

The selectively, intermittently operable drive means for causing the rotor mounted on its axle to spin rapidly and continuously for a predetermined period of time is well within the ordinary skill of the artisan to devise. It is possible to employ drive means which require human intervention, are periodic, and are not part of the toy itself, for example pulling a cord wound spirally around the axle, thereby causing it and the attached flywheel to spin. However, such drive means are less than optimum because of the short period of time during which the gyroscope performs, the rapidly declining stabilization resulting from the diminishing speed of the rotor, and the requirement for the application of an outside force initially. The selectively, intermittently operable drive means may an internal combustion engine, preferably of the miniaturized version that runs on petroleum distillate fuels. However, while such a power plant offers the advantage of a very high ratio of power to the weight and space which it occupies, it has the corresponding disadvantges of high noise level, and the production of exhaust gases. Thus, the most preferred drive means is an electric motor powered by an electric battery. This permits dean, quiet, and efficient performance by the gyroscopic means for extended periods of time. The use of rechargeable batteries can improve the advantages of this approach to an even greater extent. The transmission of power from the drive means to the gyroscopic means may be as simple as an extension of the main shaft of the electric motor, where one is used. Optionally, however, transmission means may be employed for connecting the drive means to the axle of the gyroscopic means, and this is preferably a drive shaft. Other transmission means are suitable, however, and can be employed where the axle of the gyroscope rotor is not in line with the main shaft of the electric motor. For example, a pinion or worm gear together with suitable gear trains may be used, or a flexible drive shaft of appropriate design can also be employed.

The drive means for the toy of the present invention is selectively operable. Most basically, this merely means that the drive means and power source therefor have "on/off" capability. With more complex toy designs within the scope of the present invention, the selective operability of the drive means may be used to power only the gyroscopic means, to power only the movement of the appendages, to power only the directional movement of the toy itself, or to power any combination of these three actions, or any additional actions of the toy which are performed by the drive means. As already discussed, the drive means can be connected by transmission means to the axle of the gyroscope. By the use of suitable gear trains, it is possible to develop different amounts of torque from a given speed (rpm's) of the drive means. Different torques may be desired for movement of the gyroscopic means, the appendages and the toy itself. Indeed, it may be desired to establish several different gear trains and provide for selective application of these. While it is not necessary that the means for permitting independent directional movement of the toy be operably connected to the selectively, intermittently operable drive means, this is one of several preferred embodiments of the present invention. All of these possible modes of operation fall within the scope of the present invention.

One or more appendages are joined to the toy of the present invention.

The term "appendage" as used herein has its accustomed meaning of "an adjunct to something larger or more important" where the toy is other than a human or animal figure, and of "a subordinate or derivative body part" where the toy is a human or animal figure. Typically the appendage is an arm or a leg or a head. The appendage is attached to and supported by the body portion of the toy. The manner of attachment and support of the appendage can vary considerably, but a typical attachment would consist of the appendage being rotatably mounted upon a vertical axis, including a plug or insert which snapfits into an aperture in the toy body, with the insert having a rectangular collar with a rectangular slot therein, which receives a rectangular extension portion of a pivot shaft pivotally mounted in a bearing mounted in the toy body. In another type of construction, roller gears may be used to reverse the action, e.g., clockwise rotation, of a drive shaft. Many other such constructions for attachment which permits movement would be readily apparent to the toy-making artisan.

Where the toy of the present invention is a human or animal figure, it is further provided that the body portion may consist of further subportions capable of movement relative to one another. For example, the hips and torso would comprise such subportions of the toy body, as well as the head, which may not be regarded as an appendage. Where such subportions are provided and it is desired to have them move relative to one another, as well as, possibly, in coordination with one or more of the appendages, then provision must be made to have those subportions operatively connected by transmission means to the selectively, intermittently operable drive means, which can move those subportions in a predetermined manner. For example, right and left offcenter movement of the torso may be controlled separately, whereas hip. rotation is tied to movement of the arms. Hip rotation may take place freely on roller bearings, and then be restored to the starting position by the action of a spring means. It is also provided that the appendages are operatively connected by transmission means to the selectively, intermittently operable drive means for moving the appendages in a predetermined manner. With respect to either the toy body subportions or the appendages, the transmission means comprise mechanical constructions of which the toy-making artisan would be well aware. By using transmission means comprising various clutches, cams, stems, shafts, slots and gear trains, the body subportions and appendages can be made to tilt, turn, rotate and oscillate about various axes, and through the application of reduction gears, can be made to move at different speeds.

The means for permitting independent directional movement of the toy of the present invention can comprise nothing more than a single wheel which can freely rotate about an axle, with power optionally applied to that wheel to provide powered, pre-selected, independent directional movement. Or the means can be a ball which can pivot freely within a socket, although in the case where it is desired to power the movement, it will be necessary to provide some independent means for doing so. The means for permitting directional movement is also that on which said body portion of the toy is supported. It is not required that the means for permitting independent directional movement of the toy be operatively connected by transmission means to the selectively, intermittently operable drive means, or some other drive means. Accordingly, the toy can move or be moved about freely, either in a given direction or randomly, at the whim of the operator of the toy. Indeed, even where such transmission means exist, as is preferred, it is still desirable to retain this mode of movement, i.e., where the means for permitting, independent directional movement of the toy is essentially disconnected from the transmission means.

Where the means for permitting independent directional movement of the toy is powered, it is not required that said power be derived from the selectively, intermittently operable drive means. It can be derived from one or more independent power sources, and this can even be a necessary feature of the toy. For example, in a preferred embodiment of the present invention in which the toy is a toy human figure with two arms and legs and a lower torso portion which is capable of leftward and rightward movement, it is very difficult to transmit power from the selectively, intermittently operable drive means, which lies above the moving portion, because that movement will tend to interfere with any transmission means which is employed. This would certainly be extremely difficult to accomplish using only a straight drive shaft as the transmission means. In this embodiment, it has been found expedient to utilize independent power sources in the form of an electric motor powered by a set of batteries in each leg of the toy figure. The toy will thus have three electric motors in all. It is also not necessary that the arms or other appendages be powered only by operable connection to the selectively, intermittently operable drive means. Independent drive means, such as the separate electric motors powered by sets of batteries used for directional movement of the legs of the preferred embodiment toy figure, could be employed in an analogous manner as the drive means for the arms or other appendages, using conventional transmission means in a straightforward manner.

A critical feature of the means for permitting independent directional movement of the toy of the present invention is that it resist the natural precessional forces of said gyroscopic means. In accordance with the natural workings of a gyroscopic means for gyrostabilizing a toy of the present invention, when the toy encounters outside, opposing forces, e.g., when it is struck a blow, jostled or pushed by a similar toy during mock combat, or when its directional movement brings it into contact with some immovable object, the natural tendency of the gyroscopic means will be to precess, i.e., to undergo random rotation. Such precession is unacceptable largely because it effectively eliminates the relatively precise control of the toy which is otherwise possible.

In order for the means for permitting directional movement of the toy of the present invention to resist such precessional forces, several strategies may be employed, either separately or together in various combinations. The first strategy is to provide for adequate contact area between the means for permitting directional movement and the surface over which it moves. Where the means for permitting directional movement is, e.g., a wheel, it should be larger than smaller, and two or more wheels may be provided in relatively close proximity to each other, the important factor being contact area, and not support stability, for which the gyroscopic means is primarily responsible. The second strategy is to provide an anti-slid composition as the material from which the means for permitting independent directional movement is made. Anti-skid compositions, which substantially increase contact friction between two surfaces, are well known. Elastomeric materials such as natural and synthetic rubbers are examples of such compositions, as are other natural and synthetic polymer compositions. Fillers, e.g., hard particulate matter such as silica and alumina, can also increase the anti-slid properties of a given material. The third strategy for improving the ability of the means for permitting independent directional movement to resist the precessional forces of the gyroscopic means is to provide configurations and cross-sectional designs for said means which will create resistance to the random rotation caused by precession of the gyroscopic means. For example, where said means is one or more wheels, a concave, rather than convex cross-section would create such resistance. Making said means the endless belt of a tracked locomotion system will also create such resistance. It is also possible to combine two or more of these strategies, e.g., using a wheel with a concave cross-section which is made of synthetic rubber and filled with an anti-slid composition.

As a result of the gyroscopically stabilized movements of the toys of the present invention, where those toys are human or animal figures, and especially human figures, it is possible to have the means for permitting independent directional movement, which is also operatively connected by transmission means to the selectively, intermittently operable drive means, located in just one leg of the toy figure, while the other leg is provided with a passive means, e.g., a freely rotating wheel. The significantly improved gyroscopic stability of the toys of the present invention affords a broad spectrum of design possibilities not heretofore available. For example, a toy figure might be a ballerina which pirouettes on one toe while her arms move in a prescribed or remotely controlled manner. The toy figure might be an animal such as circus elephant or performing seal that is balanced on a sphere which moves, while its appendages move in a prescribed or remotely controlled manner. Two or more such toy figures may be employed together in contests of various types. The toy figures may be human boxers in which the arms are remotely controlled, and the significantly enhanced gyroscopically stabilized movements permit a good approximation of a boxing match in real life. The toy figures may be team players, e.g., a hockey player clutching a hockey stick which can be remotely controlled to swing at a hockey puck in a reasonable simulation of a real life hockey player. Other embodiments within the scope of the present invention will readily suggest themselves to the toy-making artisan of ordinary skill, armed with the present disclosure.

Where the selectively, intermittently operable drive means is an electric motor, the toy of the present invention is preferably also equipped with switching means in electrical communication with the electric motor through electrical connection means, in order to make it selectively operable. This can simply be an on/off function, but preferably the switching means is for a number of different movement sequences, e.g., a repetitive movement of the legs and/or arms, or a circular directional movement. More preferably still, the toy is equipped with remote control means consisting of transmitting means and receiving means, so that the selective operability of the drive means is controlled remotely by means of radio signals. The transmitted radio signals can be used to control a number of different actions in the toy. In addition to turning the drive means on and off and controlling its speed, the control signals can determine to which parts of the toy the transmission means will be activated, usually by means of a solenoid. The movements of the appendages and subportions of the toy body can be controlled in this manner, as well as the independent directional movement of the toy itself.

The design of the transmitting and receiving components of the remote control system can be in accordance with conventional principles. A battery-powered transmitter energizes a transistor coupled for oscillation at a frequency determined by a crystal oscillator with suitable biasing provided by resistors and capacitors, which transmits a signal through an antenna. A tuned circuit is provided in circuit relation between the collector and emitter of the transistor by means of a transformer having its primary in parallel with a capacitor and its secondary coupled in series relation through an inductor to the antenna. The circuitry of the receiver basically includes a receiver section and a control section, with the coil of a relay connected in circuit relation with the output transistor of the control section. The relay includes the coil along with two poles movable simultaneously from a first normal position to an energized position. Actuation of the relay results in the reversing of the polarity of the power source to the motor. A second battery provides the power for the transistors of the receiver section and control section. The transistors comprise a power amplifier section operable in response to receipt of an incoming signal of the proper frequency. The signal is amplified through a series of transistors, smoothed by capacitors and a diode to provide an approximately steady state current through the relay coil.

DESCRIPTION OF PREFERRED EMBODIMENTS

FIG. 1 shows an exterior and partial interior view of a toy figure hockey player 1 of the present invention, holding a hockey stick 3 in arms 5 and 7. Movement of the arms in the direction 9 shown, is caused by gear train 11 connected to drive shaft 13, connected in turn to the selectively, intermittently operable drive means comprising electric motor 15, which derives power from battery area 17. This embodiment of the present invention illustrates the single drive shaft type of toy in which an electric motor powers essentially all of the movements of the toy by way of transmission means comprising a single, central drive shaft This design offers simplicity and reliability, but many other transmission means are possible. Also mounted on drive shaft 13 and powered by electric motor 15, is gyroscopic means 19; as well as the means for permitting directional movement of the toy comprising two wheels 21. For aesthetic reasons, the presence of the wheels has been obscured by skirt 23.

Figure 2:
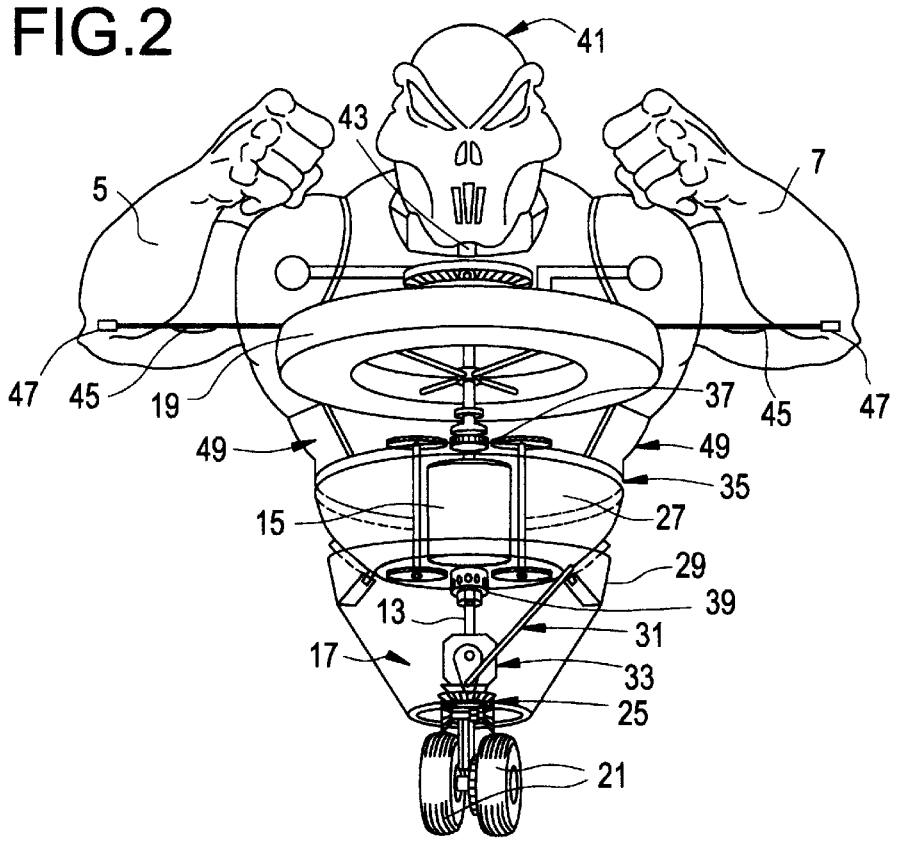
FIG. 2 is an elevational view, partly in section, of the toy figure illustrated in FIG. 1, but with additional features depicted.

FIG. 2 illustrates further embodiments useful with toy figures of the present invention. In addition to drive shaft 13, electric motor 15, battery housing 17, gyroscopic means 19, and wheels 21, the toy figure additionally includes several transmission means for actuating various movements of the toy figure. For example, gear train 25 deriving power from drive shaft 13, provides for independent forward and reverse movement of wheels 21. Torso subportion 27 rests on right-and-left pivot tracks 29, and by means of pull rod 31 connected to servo 33, deriving power from drive shaft 13, can be moved right or left of center to an angle of as much as 45°. There is also rotational pivot track 35 mounted on ball bearings (not shown) which, by means of gear trains 37 and 39, deriving power from drive shaft 13, can provide for rotation of the torso through 360°. Head 41 of the toy figure can pivot on impact, backward and forward or left and right, about pivot point 43, and a delayed slow travel return to center is provided (not shown). The electronic circuitry can be set up so that after a predetermined number of successive contacts to the pivot point, which would be equivalent to blows to the head, certain predetermined functions of the toy figure will be shut down. Arms 5 and 7 are capable of an extension movement produced by cables 45 and pulleys 47, for which rods can also be substituted. Temporary kill switches 49 are provided, and on impact will shut down the functions of the toy figure. The extent of this shutdown can be set by means of a pressure switch (not shown) to correspond to the force of the impact.

FIG. 3 is a side view of another embodiment of the present invention, which illustrates still further means for constructing the toy figures of the present invention. In addition to drive shaft 13, battery housing 17, gyroscopic stabilizer means 19, wheels 21, lower torso subportion 27, upper torso subportion 53, and ball bearing mounted shaft engaging arm 55, the toy figure additionally includes several transmission means for actuating various movements of the toy figure. For example, when servo 61 is activated, it will, by means of the rod 63, simultaneously cause ball bearing mounted shaft engaging arm 55 to engage drive shaft 13 and transmit power therefrom, and pushing up on rocker arm 65, cause clutch engagement arm 67 to engage clutch assembly 70 comprising fixed clutch plate 69, and pressor plates 71 with disengagement step plate 59. The arms (not shown) can also be rotated by means of a 90° inboard throw mechanism (not shown). A spring (not shown) returns the arms to their original position. In accordance with these means, the gyroscopic stabilizer means and both arms are activated for movement. Supporting this entire mechanism is the ball bearing mounted upper brace 73 and the ball bearing mounted lower brace 75. Power to produce all of the movements achieved by this mechanism is transmitted from electric motor 15 by means of the vertical floating keyway shaft with clutched face 77 and the ball bearing mounted shaft engaging arm 55.

FIG. 4 illustrates yet another embodiment of the present invention. In addition to the pull rod 31 which is connected to servo 33, deriving power from drive shaft 13, and which can be moved right or left of center to an angle of as much as 30°; the horizontal pivot track 35; and the arms 5 and 7 which are capable of an extension movement produced by cables 45 and pulleys 47; the toy figure additionally includes several other unique features. For example, in addition to the electric motor 15, there are two separate electric motors 79 in each of the legs of the toy figure which are used to produce independent directional movement of the toy figure by means of the gear trains 81. The packets of three, e.g., NiCd batteries 83 in each of the legs power the electric motor 15 as well as the electric motors 79. The transmitter/receiver unit 85 is part of the overall system which permits remote control of the movements of the toy figure.

Figure 5:
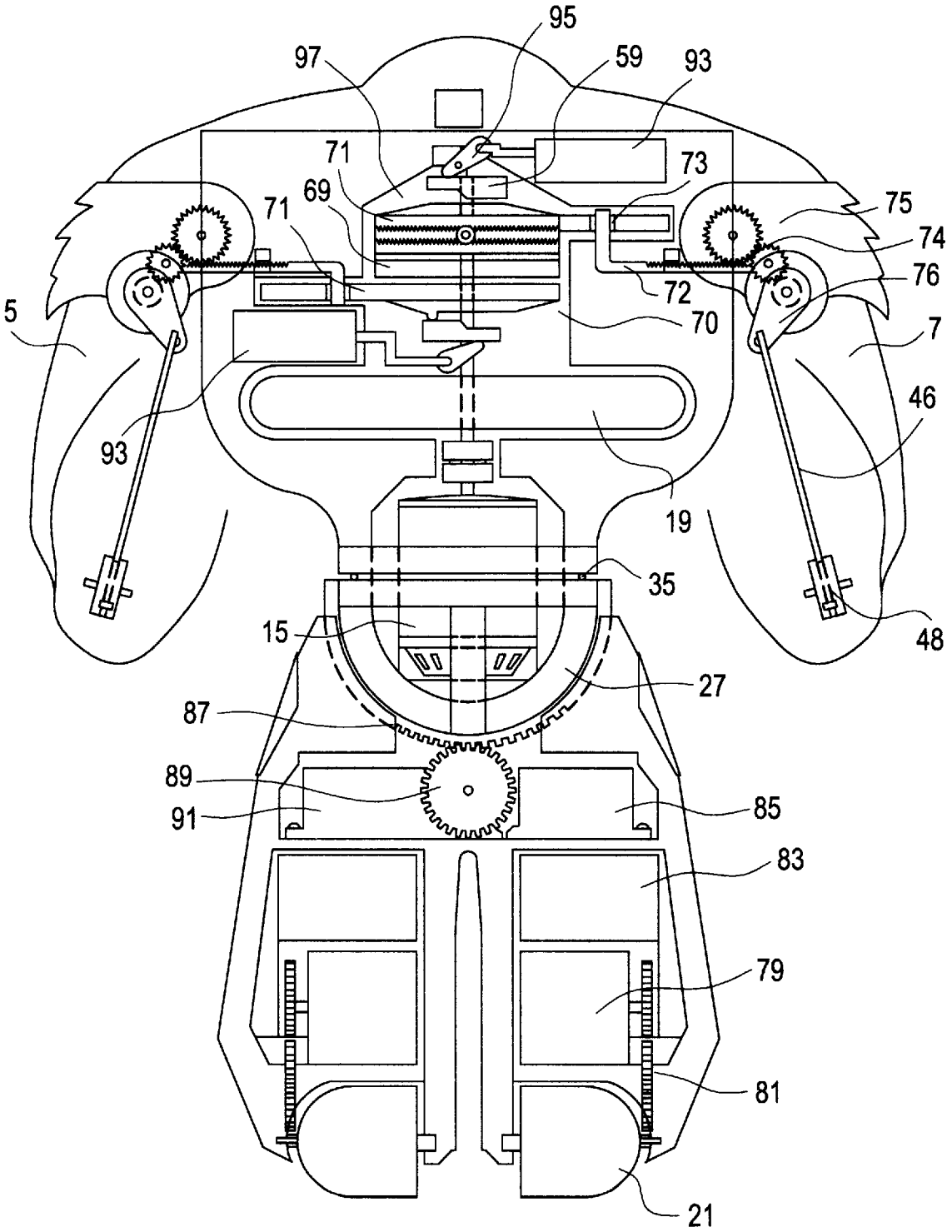
FIG. 5 is a front view, mostly in section, of a toy figure of the present invention having means for producing upward movement of the shoulders.

FIG. 5 is a front view of another embodiment of the present invention. In addition to arms S and 7 which are extended by push rods 45 and pivot means 47; electric motor 15; gyroscopic stabilizer 19; wheels 21; torso subportion 27 which rests on right-and-left pivot track 87 and is actuated by gear train 89 connected to servo 91; rotational pivot track 35; clutch assembly 70 comprising fixed clutch plate 69, pressor plates 71, and disengagement step plates 59; electric motor 79 and gear train 81 which provide directional movement to the toy figure; the packet of three NiCd batteries 83 which power electric motor 79; the toy figure illustrated additionally includes several other unique features. For example, when solenoids 93 are activated and rotate cam assemblies 95, which cause disengagement step plates 59 to force pressor plates 71 into engagement with fixed clutch plate 69. The resulting rotation of pressor plates 71 engages drive rods 72 by means of a curved slot 73, forcing drive rods 72 outward, where notched ends 74 thereof engage gear train 75. The rotation of gear train 75 is translated into lateral movement of push rods 46 by means 76, which in turn powers movement of the upper and lower arms through means 48. These various means are housed within and anchored directly or indirectly to framework 97, a part of which is identified by that reference figure.

Figure 6:
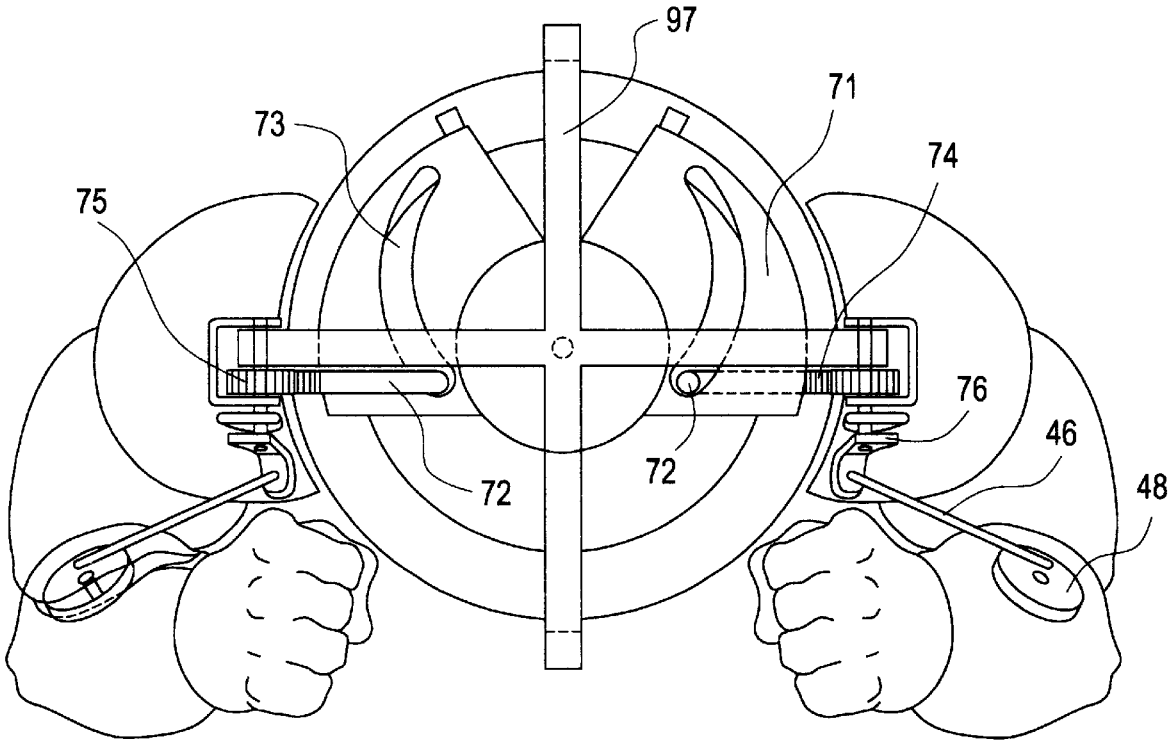
FIG. 6 is a top view, partly in section, of the toy figure illustrated in FIG. 5, showing detail of the pressor plate, drive rod and other components responsible for producing upward movement of the shoulders.

FIG. 6 is a top view of the embodiment in FIG. 5, partially in cross section. In particular, it shows more detail of curved slot 73 in pressor plate 71, as well as means 76 and 48 for translating movement of drive rods 72 into movements of the upper and lower arms. These various means are housed within and anchored directly or indirectly to framework 97.

Figure 7:
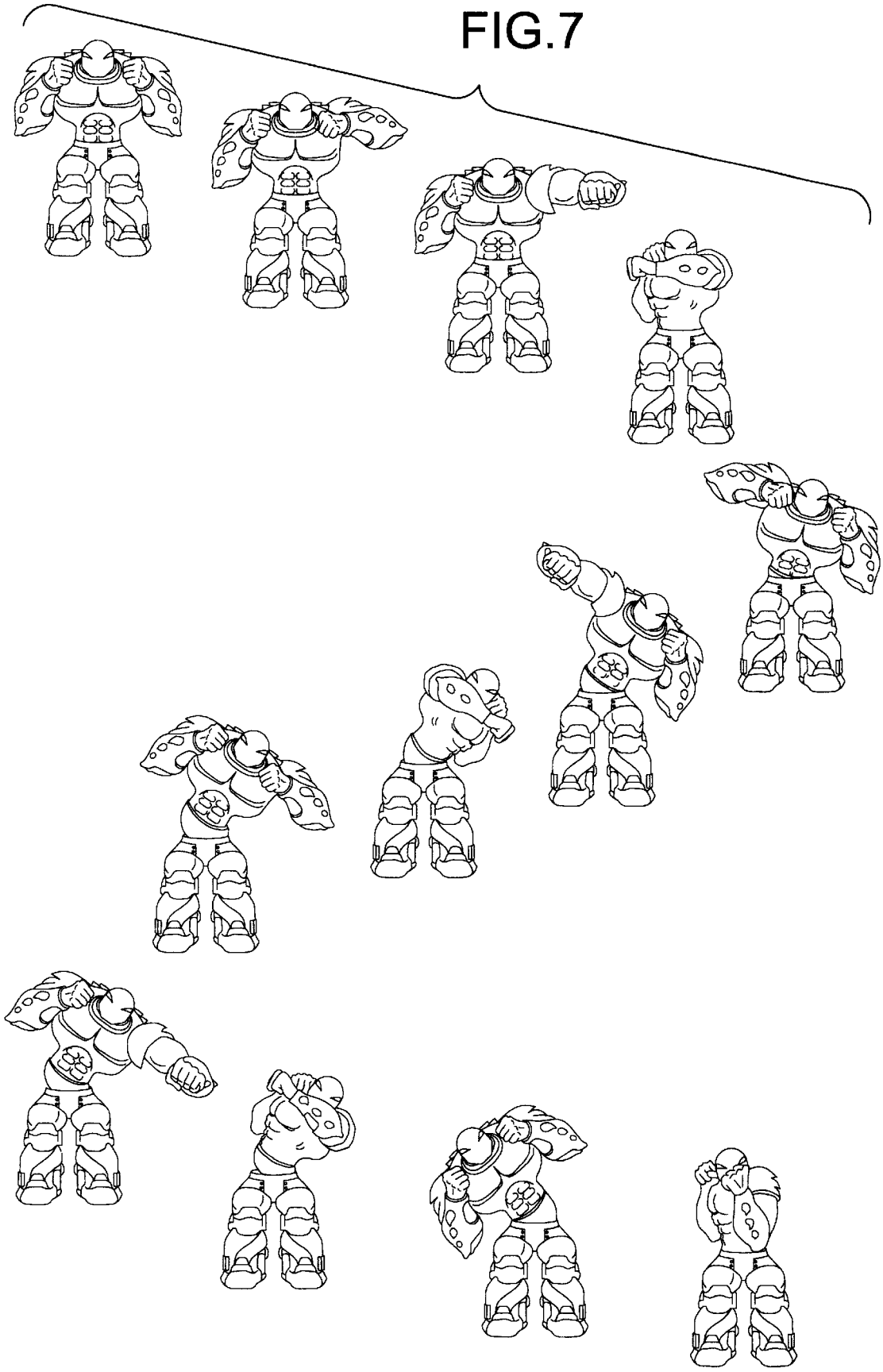
FIG. 7 depicts a series of toy figures which illustrate the exterior appearance of one embodiment of the body portion thereof, which houses and supports the constituent elements thereof; and which also illustrate the various combinations of movements of the arms, shoulders, torso and hips of the toy figure which may be achieved in accordance with the present invention.

FIG. 7 illustrates the outside appearance of one of many possible embodiments of the present invention, in this instance, a futuristic android. The body portion which is depicted houses and supports the constituent elements of the toy figure, which are concealed inside that body. The various constituent parts of the body portion of the figure will have been made of molded and extruded thermoplastic materials, and fitted together, including attachment to the inner parts of the figure which provide movement for those parts. There is further illustrated herein the range of movements of which this particular embodiment, described in detail further above, is capable. The movements are shown in the approximate sequence that would be produced by the actions of the various above-described mechanical means.

What is claimed is:

1. A toy capable of rolling atop a support surface comprising:

a body;

gyroscopic means mounted in said body for providing, gyrostabilization, said gyroscopic means including:

an axle rotatably mounted to said body and defining an axis of rotation;

a rotor attached to said axle and capable of spinning about said axis; and means for attaching said axle to said body, wherein said axle is free to rotate about at least one axis which is perpendicular to said axis of rotation;

selectively, intermittently operable drive means connected to said gyroscopic means for causing said axle and said rotor to spin with sufficient speed to gyrostabilize said toy;

at least one appendage attached to said body;

translation means disposed at the lower portion of said toy for permitting independent directional translational movement of said toy over the support surface, said translation means forming the bottom of said toy, said translation means including at least one rolling member which provides at least one contact area for providing frictional contact with the support surface which resists the natural precessional forces of said gyroscopic means, and which substantially prevents rotation of the lower portion of said toy about an upright axis extending up from the support surface; and a remote control for selectively controlling the gyroscopic rotation of said gyroscopic means and the motion of said at least one rolling member;

wherein said at least one rolling member is selectively motor driven by said drive means or a second drive means in response to said remote control.

2. A toy according to claim 1 wherein said toy is a humanoid figure and said appendages comprise one or more arms, legs, tails or trunks.

3. A toy according to claim 1 wherein said body comprises:

an exterior shell; and an interior framework integrated with said exterior shell for providing structural support.

4. A toy according to claim 3 wherein said body further comprises a plurality of subportions, including: head, neck, upper torso and lower torso subportions.

5. A toy according to claim 2 wherein said appendage has associated therewith an object, wherein said object is one of a piece of sports equipment and a weapon.

6. A toy according to claim 1 wherein said gyroscopic means includes a gyroscopic mount of two-frame construction; and wherein said rotor has appreciable mass concentrated toward its rim.

7. A toy according to claim 1 wherein said selectively, intermittently operable drive means includes an electric motor, an electric battery for powering said electric motor, and a drive shaft which selectively connects said electric motor to said gyroscopic means, wherein said drive means causes said axle and said rotor of said gyroscopic means to spin, when said drive means is connected to said gyroscopic means, with sufficient speed to stabilize said toy, wherein said drive means is capable of being alternately connected and disconnected thereto.

8. A toy according to claim 7 wherein said selectively, intermittently operable drive means is available to provide power to at least one of said appendages and said translation means when said drive means is disconnected from said gyroscopic means.

9. A toy according to claim 7 further comprising switching means mounted in said body and electrically connected to said electric motor, thereby permitting selective and intermittent operation of said drive means.

10. A toy according to claim 7 further comprising receiving means attached to said body for receiving a radio signal, in combination with a transmitting means for remotely generating said radio signal, wherein said receiving means causes said drive means to be powered in response to said radio signal, thereby permitting remote controlled selective and intermittent operability of said drive means.

11. A toy according to claim 2 further comprising transmission means for operatively connecting said one or more appendages to said selectively, intermittently operable drive means.

12. A toy according to claim 11 wherein said one or more appendages have associated therewith mechanical linkages for imparting a variety of movements and gestures thereto.

13. A toy according to claim 2 wherein said selective and intermittent operability of said drive means may be used to power said gyroscopic means only, the movement of said appendages only, the independent directional movement of said toy figure only, or any combination of the above.

14. A toy according to claim 1 wherein said translation means is operably connected to said selectively, intermittently operable drive means.

15. A toy according to claim 1 wherein said at least one rolling member comprises one or more wheels, rollers, spheres or tracks, or any combination thereof.

16. A toy according to claim 1 wherein the materials from which said toys are fabricated comprise at least one of: (1) polymeric materials comprising one or more members selected from the group consisting of thermoplastic resins comprising polyolefins, polyvinylchlorides, polytetrafluoroethylenes, acrylonitrile-butadienestyrenes, polymethacrylates, polyamides, polyesters, polystyrenes, and polycarbonates, and thermosetting resins; (2) a material selected from (1) having incorporated therein strength-imparting materials in particulate, fibrous or filamentous form selected from the group consisting of metal, glass, cellulose and cellulose derivatives, synthetic resins, and carbon and carbonaceous compositions, so as to form composite structures; and (3) metals selected from the group consisting of brass, bronze, steel, aluminum and titanium.

17. A toy according to claim 16 wherein lubricants of the permanent, sealed type, are included in the fabrication of said toy so as to provide lubrication to said consistent elements thereof comprising elements in moving contact with each other.

18. A toy according to claim 2 wherein said toy is a toy human figure having two arms and two legs and a lower torso portion which is capable of pivoting left and right with respect to the lower portion of said figure said toy further comprising at least one independent power source disposed in at least one of said legs, said power source including at least one electric motor and at least one battery.

19. A toy according to claim 1 wherein said translation means comprises one or more wheels at least partially made from an anti-skid composition, said composition comprising one or more members selected from the group consisting of natural and synthetic rubbers and polymers containing one or more fillers comprising hard particulate matter; wherein said one or more wheels have a concave cross-section.

20. A toy according to claim 1 wherein said selectively, intermittently operable drive means is an internal combustion engine.

21. A toy according to claim 1 further comprising a transmission means for connecting said at least one appendage to said selectively, intermittently operable drive means, whereby said selectively, intermittently operable drive means is capable of powering said at least one appendage.

22. A toy according to claim 1 further comprising an independent drive means for moving said at least one appendage in a predetermined manner.

23. A toy according to claim 1 wherein said axis of rotation is substantially vertical.

24. A toy according to claim 1 wherein said toy is an animal figure and said appendages comprise one or more arms, legs, tails or trunks.

* * * * *